US012729505B2

(12) United States Patent
Krone et al.

(10) Patent No.: US 12,729,505 B2
(45) Date of Patent: Sep. 8, 2026

(54) DETERMINATION OF A DYNAMIC TARGET PLANE FOR AN IMPLEMENT OF A MACHINE BASED ON FILTERED DYNAMIC TRACK PLANE PARAMETERS

(71) Applicant: Caterpillar Inc., Peoria, IL (US)

(72) Inventors: Bradley Paul Krone, Dunlap, IL (US); Joseph Leo Faivre, Edelstein, IL (US); Jason Braker, Speer, IL (US); Kaivalya Vijay Khorgade, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 18 days.

(21) Appl. No.: 19/045,121

(22) Filed: Feb. 4, 2025

(65) Prior Publication Data

US 2026/0226702 A1 Aug. 6, 2026

(51) Int. Cl.
*E02F 3/84* (2006.01)
*E02F 9/26* (2006.01)

(52) U.S. Cl.
CPC ..... *E02F 3/844* (2013.01); *E02F 9/262* (2013.01)

(58) Field of Classification Search
CPC ..... E02F 3/844; E02F 9/262
See application file for complete search history.

(56) References Cited

U.S. PATENT DOCUMENTS 7,121,355 B2 10/2006 Lumpkins et al.
8,145,391 B2 3/2012 Omelchenko et al.
8,473,166 B2 6/2013 Zhdanov et al.
9,328,479 B1 5/2016 Rausch et al.
9,617,717 B2 4/2017 Kondo et al.
9,624,643 B2 4/2017 Hendron et al.
10,017,919 B2 7/2018 Nomura et al.
10,428,493 B2 10/2019 Omelchenko et al.
10,876,272 B2 12/2020 Faivre et al.
10,961,686 B2 3/2021 Green et al.
11,174,619 B2 11/2021 Ishibashi et al.
11,629,477 B2 4/2023 Velde et al.
2009/0056961 A1* 3/2009 Gharsalli ..... E02F 3/844 172/779
2011/0153171 A1* 6/2011 Krause ..... E02F 3/844 701/50
2012/0059554 A1 3/2012 Omelchenko et al.
2013/0261902 A1* 10/2013 Zhdanov ..... E02F 3/7618 701/50
2015/0308074 A1* 10/2015 Zhdanov ..... E02F 3/847 701/50
2023/0374750 A1 11/2023 Schamberger et al.
2023/0400865 A1 12/2023 Krone et al.
2024/0134064 A1 4/2024 Ishihara et al.

* cited by examiner

*Primary Examiner* — Richard M Camby

(57) ABSTRACT

In some implementations, a controller of a machine may determine plane offset information associated with a reference target plane for an implement of the machine and a reference track plane of the machine. The controller may determine one or more dynamic track plane parameters associated with a dynamic track plane of the machine. The controller may modify, using one or more filters, the one or more dynamic track plane parameters. The controller may determine, based on the modified one or more dynamic track plane parameters and the plane offset information, a dynamic target plane for the implement. The controller may control the implement based on the dynamic target plane.

20 Claims, 11 Drawing Sheets

DETERMINATION OF A DYNAMIC TARGET PLANE FOR AN IMPLEMENT OF A MACHINE BASED ON FILTERED DYNAMIC TRACK PLANE PARAMETERS

TECHNICAL FIELD

The present disclosure relates generally to a machine and, for example, to determination of a dynamic target plane for an implement of the machine.

BACKGROUND

Machines may be used to perform a variety of tasks at a worksite. For example, machines may be used to excavate, move, shape, contour, and/or remove material present at the worksite, such as gravel, concrete, asphalt, soil, and/or other materials. To achieve a desired outcome of a machine's work operation, it is often important to align the machine's implement with a target plane during the operation. For example, when the machine is a dozer with a blade as implement, it may be desirable to align the blade with a target plane to ensure that a work surface, that is being worked on by the machine, is leveled or sloped to match a desired grade.

However, when the machine traverses an uneven work surface, a track plane of the machine changes, which causes undesired movement of the implement. Consequently, controlling the implement to remain aligned with the target plane during performance of the operation is challenging. Further, while maintaining alignment with target plane is an ideal goal for the implement, rigidly trying to readjust the implement to match the target plane often results in a "choppy" movement of the implement, which affects a quality of the outcome of the work operation. For example, when the machine is a dozer and traverses a bumpy work surface that frequently changes the track plane of the machine, the blade of the machine is often frequently repositioned to compensate, which results in an unsmooth dozed work surface, also referred to as a washboard work surface.

The controller of the present disclosure solves one or more of the problems set forth above and/or other problems in the art.

SUMMARY

In some implementations, a machine includes an implement, and a controller configured to: determine a reference target plane for the implement for when the machine performs an operation; determine one or more reference target plane parameters associated with the reference target plane; determine one or more reference track plane parameters associated with a reference track plane of the machine; determine, based on the one or more reference target plane parameters and the one or more reference track plane parameters, plane offset information; determine, when the machine performs the operation, a dynamic track plane of the machine; determine one or more dynamic track plane parameters associated with the dynamic track plane; modify, using one or more filters, the one or more dynamic track plane parameters; determine, based on the modified one or more dynamic track plane parameters and the plane offset information, a dynamic target plane for the implement; and control the implement based on the dynamic target plane.

In some implementations, a controller of a machine includes one or more memories, and one or more processors, coupled to the one or more memories, configured to: determine one or more reference target plane parameters associated with a reference target plane for an implement of the machine for when the machine performs an operation; determine, based on the one or more reference target plane parameters and one or more reference track plane parameters associated with a reference track plane of the machine, plane offset information; determine, when the machine performs the operation, one or more dynamic track plane parameters associated with a dynamic track plane of the machine; modify, using one or more filters, the one or more dynamic track plane parameters; determine, based on the modified one or more dynamic track plane parameters and the plane offset information, a dynamic target plane for the implement; and control the implement based on the dynamic target plane.

In some implementations, a method includes determining, by a controller of a machine, plane offset information associated with a reference target plane for an implement of the machine and a reference track plane of the machine; determining, by the controller, one or more dynamic track plane parameters associated with a dynamic track plane of the machine; modifying, by the controller, using one or more filters, the one or more dynamic track plane parameters; and determining, by the controller, based on the modified one or more dynamic track plane parameters and the plane offset information, a dynamic target plane for the implement.

DETAILED DESCRIPTION

This disclosure relates to a controller of a machine that includes an implement and is applicable to any machine that performs an operation (e.g., using the implement). For example, the machine may be any machine that performs an operation associated with an industry such as, for example, mining, construction, farming, transportation, or any other industry. As some examples, the machine may be a dozer, a tractor, a tractor scraper, a backhoe loader, a wheel loader, a harvester, an excavator, a motor grader, a skid steer loader, a cold planer, a compactor, a feller buncher, a forest machine, a forwarder, an industrial loader, a knuckleboom loader, a material handler, a pipelayer, a road reclaimer, a skid steer loader, or other above-ground equipment, or underground equipment.

Figure 1:
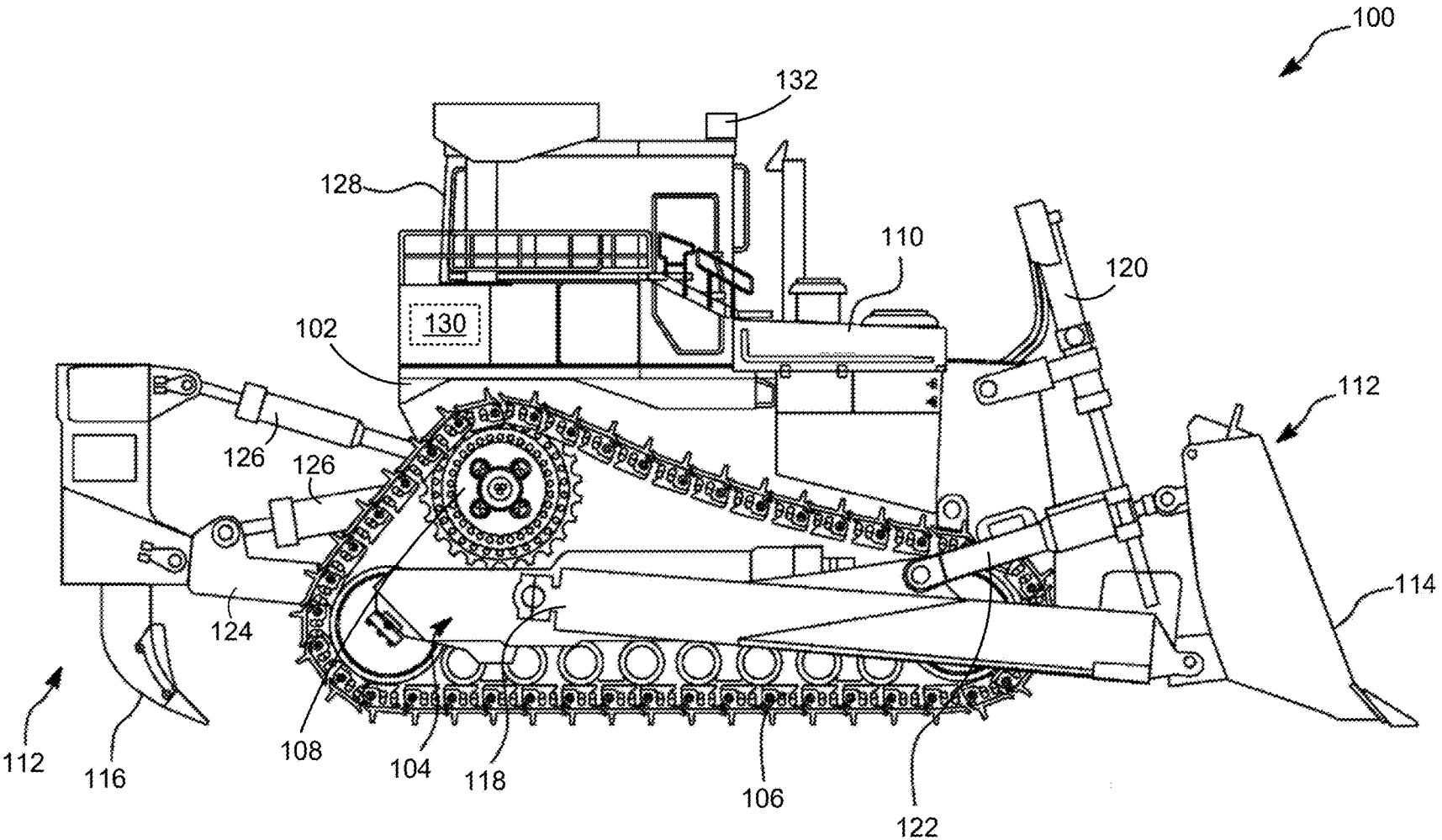
FIG. 1 is a side view of an example machine.

FIG. 1 is a side view of an example machine 100. The machine 100 may perform earth moving, excavation, or another operation associated with an industry such as construction or mining, among other examples. That is, the machine 100 is a work machine. For example, as illustrated in FIG. 1, the machine 100 is a dozer. However, the machine 100 may be another type of machine, as described above.

The machine 100 includes a frame 102 that is supported by an undercarriage 104 used to propel the machine 100 in a forward direction and/or a rearward direction. The undercarriage 104 is configured to engage a ground surface, such as a road or another type of terrain. The undercarriage 104 includes a pair of endless tracks 106 (only one endless track 106 is visible in FIG. 1) driven by respective drive wheels 108. Although the machine 100 is illustrated as having tracks 106, the undercarriage 104 may additionally, or alternatively, include one or more wheels for propelling the machine 100.

The frame 102 supports a prime mover 110. The prime mover 110 may include an engine (e.g., an internal combustion engine), such as a diesel engine, a gasoline engine, or a gaseous fuel engine, among other examples. Additionally, or alternatively, the prime mover 110 may include an electric motor (e.g., for electric powering of machine 100 or hybrid powering of machine 100 with the engine). The prime mover 110 is configured to provide power to drive the tracks 106. Furthermore, the prime mover 110 is configured to provide power to one or more implements 112 (e.g., by driving one or more hydraulic pumps that provide pressurized fluid to one or more actuators of the machine 100).

In FIG. 1, the implements 112 are illustrated as a blade 114, attached to a front of the machine 100, and a ripper 116 attached to a rear of the machine 100. Other embodiments can include any other suitable implement 112 for a variety of tasks, including, for example, dozing, brushing, compacting, grading, lifting, loading, plowing, and/or ripping, among other examples. Example implements 112 include a stump grinder, a trencher, a broom, a brush cutter, a cold planer, a moldboard, a hook, a backhoe, a mower, a mulcher, a processor, a pulverizer, a rake, a saw, a snow product, a snow blower, a tiller, a winch, an auger, a bucket, a scoop, a breaker/hammer, a compactor, a cutter, a forked lifting device, a grader bit and end bit, and/or a grapple, among other examples.

The implements 112 are movable with respect to the frame 102. For example, the blade 114 may be pivotally connected to the frame 102 by arms 118 on each side of the machine 100. One or more first hydraulic cylinders 120 may be coupled to the frame 102 to support the blade 114 in the vertical direction and allow the blade 114 to move up or down vertically. Additionally, one or more second hydraulic cylinders 122 may be included on each side of the machine 100 to allow a pitch or an angle of the blade 114 to change. The first and second hydraulic cylinders 120, 122 may be actuators that receive actuation instructions to adjust, lift, lower, or otherwise move and/or position the blade 114. Similarly, the ripper 116 may be pivotally connected to the frame 102 by one or more arms 124, and one or more hydraulic cylinders 126 may be coupled to the frame 102 to support the ripper 116 and allow the ripper 116 to move up or down vertically.

An operator station 128 may be supported on the frame 102. The operator station 128 may include an operator console having one or more displays (e.g., touchscreen displays) and/or one or more operator controls to operate and/or drive the machine 100. For example, the operator controls may include a joystick, a lever, and/or a knob, among other examples. The machine 100 includes a controller 130 for electrically controlling various aspects of the machine 100. For example, the controller 130 (e.g., that includes an electronic control module (ECM) or other computing device) may send and receive signals from various components of the machine 100 during the operation of the machine 100. In some implementations, the controller 130 may be configured to provide autonomous control of the machine 100, autonomous control of one or more functions of the machine 100 (e.g., propulsion, braking, steering, implement movement, or the like), and/or autonomous control of the one or more implements 112 (e.g., to automatically adjust an implement 112 to achieve a target position of the implement 112).

One or more sensors 132, configured to mount on machine 100 (e.g., to the frame 102 or the operator station 128), are communicatively coupled to the controller 130 (e.g., by a wired connection or wirelessly). The one or more sensors 132 may include one or more perception sensors, such as a sonar sensor, a camera, a light detection and ranging (LIDAR) sensor, and/or a radio detection and ranging (RADAR) sensor, or another type of sensor to perceive an environment of the machine 100. The one or more sensors 132 may include one or more machine sensors, such as a location sensor (e.g., a global positioning system (GPS) sensor, or a local positioning system sensor) configured to determine a location (e.g., a physical location) and/or a heading of the machine 100, a position sensor (e.g., a rotation sensor, or another sensor) configured to detect a position of an implement 112, a speed sensor configured to determine a speed of the machine 100 (e.g., when travelling over a surface), a steering angle sensor configured to determine a steering angle of the machine 100, and/or one or more other sensors.

As indicated above, FIG. 1 is provided as an example. Other examples may differ from what is described with regard to FIG. 1.

Figure 2A:
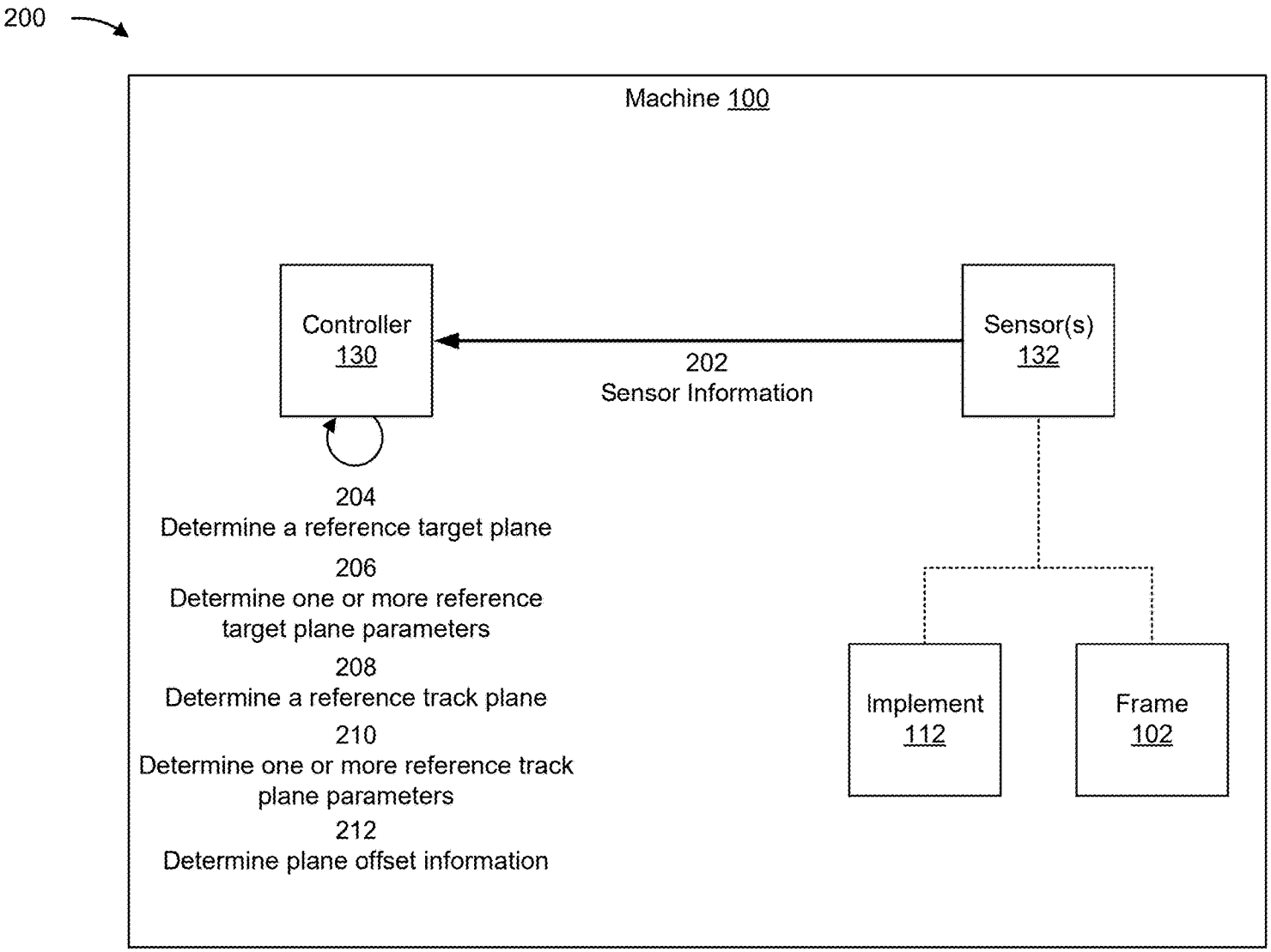
FIGS. 2A-2C are diagrams of an example implementation described herein.
Figure 2B:
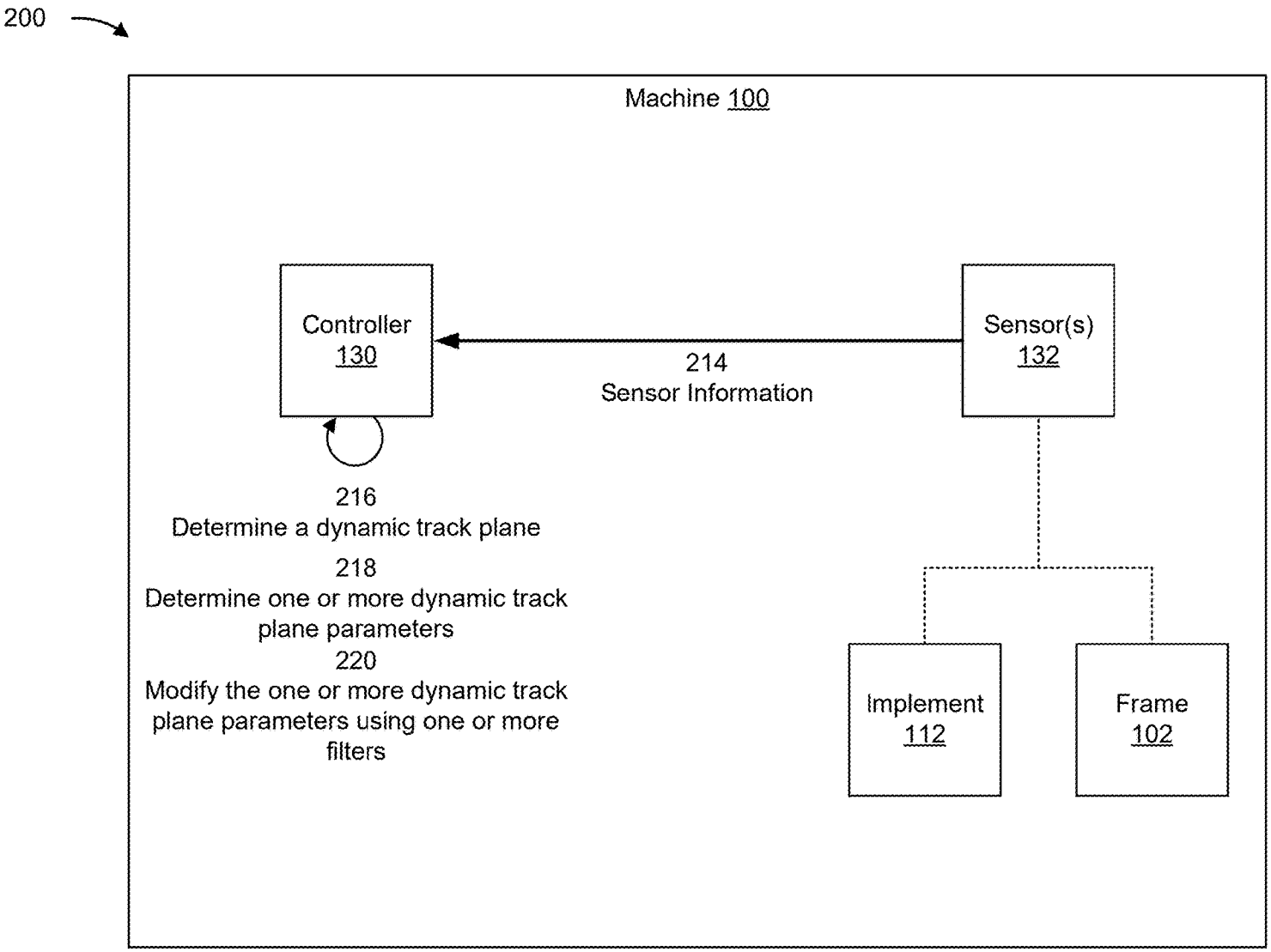
Figure 2C:
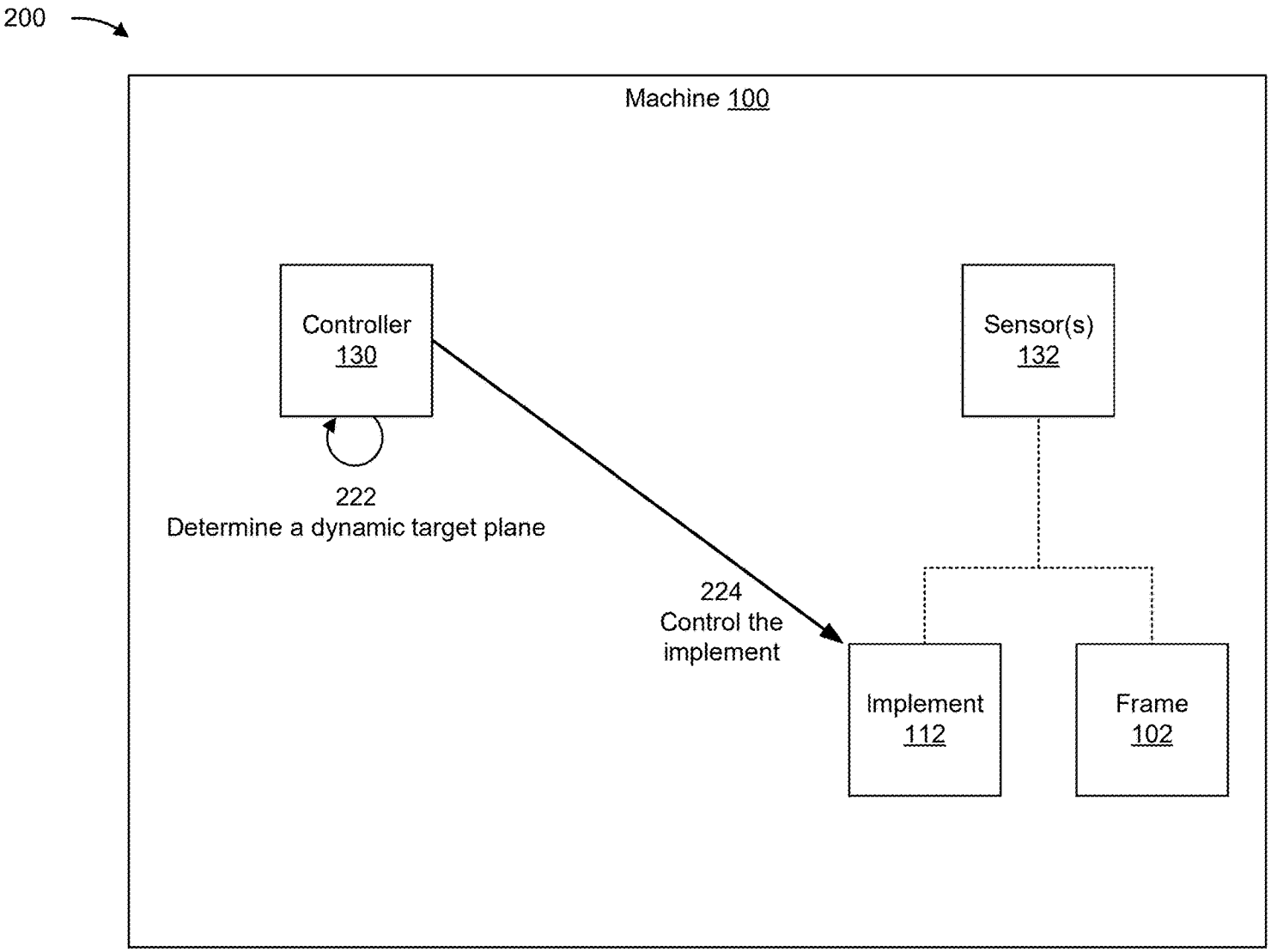

FIGS. 2A-2C are diagrams of an example implementation 200 described herein. FIGS. 2A-2C show how the controller 130 determines a dynamic target plane for an implement 112 (e.g., a blade 114, a ripper 116, or another type of implement) of the machine 100, such as based on filtered dynamic track plane parameters.

As shown in FIG. 2A, and by reference number 202, the controller 130 may obtain sensor information. For example, the controller 130 may obtain the sensor information from the one or more sensors 132. The sensor information may include respective sensor data captured by the one or more sensors 132. That is, each sensor 132, of the one or more sensors 132, may send sensor data that is captured by the sensor 132 to the controller 130 (e.g., in real time, or near real time), and therefore the controller 130 may collectively receive respective sensor data captured by the one or more sensors 132 as sensor information. The sensor information may indicate, for example, a location (e.g., a physical location) and/or a heading of the machine 100. The location may be represented in global coordinates (e.g., latitude, longitude, and/or elevation), site coordinates (e.g., a Northing, an Easting, and/or an elevation with respect to a local origin point), or other coordinates. Additionally, or alternatively, the sensor information may indicate, for example, a position of the implement 112, which may be represented in global coordinates, site coordinates, or other coordinates, and/or orientation parameters.

As shown by reference number 204, the controller 130 may determine a reference target plane. The reference target plane may be for the implement 112, such as for when the machine 100 performs an operation (e.g., a work operation, which may include utilizing the implement 112 to perform the operation). That is, the reference target plane may be a plane at which the implement 112 (or a portion of the implement, such as an edge of the implement 112) can be aligned, during performance of the operation by the machine 100, such as to enable a desired work result. For example, when the implement 112 is a blade (e.g., the blade 114), the reference target plane may be a plane at which the implement 112 can be aligned to ensure that a ground surface, which is being worked on by performance of a dozing operation by the machine 100, is leveled or sloped to match a desired grade.

The controller 130 may determine the reference target plane based on the sensor information. For example, the controller 130 may process (e.g., parse, read, and/or perform another type of process on) the sensor information to determine the position of the implement 112, and the controller 130 may determine the reference target plane based on the position of the implement 112 (e.g., may define the reference target plane as a plane that is aligned with the position of the implement 112). In some implementations, the controller 130 may determine the reference target plane based on a configuration setting of the machine 100. For example, an operator of the machine 100 may interact with the operator controls of the operator station 128 to input the configuration setting (e.g., that indicates the reference target plane), and the controller 130 may then obtain the configuration setting from the operator station 128 to thereby determine the reference target plane.

As shown by reference number 206, the controller 130 may determine one or more reference target plane parameters associated with the reference target plane. The one or more reference target plane parameters may include one or more plane orientation parameters, such as a plane Northing angle parameter (e.g., that indicates an angle between a +y axis of a coordinate system that represents the position of the implement 112 and an intersection of the reference target plane and an xz plane of the coordinate system) and/or a plane Easting angle parameter (e.g., that indicates an angle between a +x axis of the coordinate system that represents the position of the implement 112 and an intersection of the reference target plane and an yz plane of the coordinate system), and/or a plane elevation parameter (e.g., that indicates a z coordinate, of the coordinate system that represents the position of the implement 112, of an origin point of the reference target plane). In another example, the one or more reference target plane parameters may include one or more plane polar coordinate parameters, such as a plane azimuth elevation parameter, a plane heading angle, a plane elevation parameter. In an additional example, the one or more reference target plane parameters may include one or more normal vector plane parameters (e.g., that indicate components of a normal vector to the plane). The controller 130 may determine the one or more reference target plane parameters based on the sensor information (e.g., in association with determining the reference target plane, or as an alternative to determining the reference target plane).

As shown by reference number 208, the controller 130 may determine a reference track plane of the machine 100. The reference track plane may be the plane at which the machine 100 is aligned, such as when the controller 130 determines the reference target plane. That is, the reference track plane may be a plane at which the machine 100 is aligned, at a time prior to performance of the operation by the machine 100. The controller 130 may determine the reference track plane based on the sensor information. For example, the controller 130 may process (e.g., parse, read, and/or perform another type of process on) the sensor information to determine the location and heading of the machine 100, and the controller 130 may determine the reference track plane based on the location and heading of the machine 100 (e.g., may define the reference track plane as a plane that is aligned with the location and heading of the machine 100).

As shown by reference number 210, the controller 130 may determine one or more reference track plane parameters associated with the reference track plane. The one or more reference track plane parameters may include one or more plane orientation parameters, such as a plane Northing angle parameter (e.g., that indicates an angle between a +y axis of a coordinate system that represents the location and heading of the machine 100 and an intersection of the reference track plane and an xz plane of the coordinate system) and/or a plane Easting angle parameter (e.g., that indicates an angle between a +x axis of the coordinate system that represents the location and heading of the machine 100 and an intersection of the reference track plane and an yz plane of the coordinate system), and/or a plane elevation parameter (e.g., that indicates a z coordinate, of the coordinate system that represents the location and heading of the machine 100, of an origin point of the reference track plane). In another example, the one or more reference track plane parameters may include one or more plane polar coordinate parameters, such as a plane azimuth elevation parameter, a plane heading angle, a plane elevation parameter. In an additional example, the one or more reference track plane parameters may include one or more normal vector plane parameters (e.g., that indicate components of a normal vector to the plane). The controller 130 may determine the one or more reference track plane parameters based on the sensor information (e.g., in association with determining the reference track plane, or as an alternative to determining the reference track plane).

As shown by reference number 212, the controller 130 may determine plane offset information (e.g., based on the one or more reference target plane parameters and the one or more reference track plane parameters). The plane offset information may be associated with the reference target plane and the reference track plane. For example, the controller 130 may determine, and therefore the plane offset information may indicate, respective differences between corresponding plane parameters of the one or more reference target plane parameters and the one or more reference track plane parameters. In this way, the plane offset information may indicate how to transform (e.g., rotate, translate, reflect, or another type of transformation) the reference target plane to align with the reference track plane, or vice versa.

As shown in FIG. 2B, and by reference number 214, the controller 130 may obtain sensor information (e.g., updated, or additional, sensor information), such as when the machine 100 performs the operation(s) described herein. For example, the controller 130 may obtain the sensor information from the one or more sensors 132, in a similar manner as that described herein in relation to FIG. 2A and reference number 202. The sensor information may indicate, for example, a location and/or a heading of the machine 100 (e.g., an updated location and/or heading of the machine 100), such as when the machine 100 performs the operation, which may be represented in global coordinates, site coordinates, or other coordinates.

As shown by reference number 216, the controller 130 may determine a dynamic track plane of the machine 100. The dynamic track plane may be the plane at which the machine 100 is aligned, such as when the machine 100 performs the operation. That is, the dynamic track plane may be a plane at which the machine 100 is aligned during performance of the operation by the machine 100. The controller 130 may determine the dynamic track plane based on the sensor information (e.g., that was obtained from the one or more sensors 132, as described herein in relation to reference number 214). For example, the controller 130 may process (e.g., parse, read, and/or perform another type of process on) the sensor information to determine the location and heading of the machine 100, and the controller 130 may determine the dynamic track plane based on the location and heading of the machine 100 (e.g., may define the dynamic track plane as a plane that is aligned with the location and heading of the machine 100).

As shown by reference number 218, the controller 130 may determine one or more dynamic track plane parameters associated with the dynamic track plane. The one or more dynamic track plane parameters may include one or more plane orientation parameters, such as a plane Northing angle parameter (e.g., that indicates an angle between a +y axis of a coordinate system that represents the location and heading of the machine 100 and an intersection of the dynamic track plane and an xz plane of the coordinate system) and/or a plane Easting angle parameter (e.g., that indicates an angle between a +x axis of the coordinate system that represents the location and heading of the machine 100 and an intersection of the dynamic track plane and an yz plane of the coordinate system), and/or a plane elevation parameter (e.g., that indicates a z coordinate, of the coordinate system that represents the location and heading of the machine 100, of an origin point of the dynamic track plane). In another example, the one or more dynamic track plane parameters may include one or more plane polar coordinate parameters, such as a plane azimuth elevation parameter, a plane heading angle, a plane elevation parameter. In an additional example, the one or more dynamic track plane may include one or more normal vector plane parameters (e.g., that indicate components of a normal vector to the plane). The controller 130 may determine the one or more dynamic track plane parameters based on the sensor information (e.g., in association with determining the dynamic track plane, or as an alternative to determining the dynamic track plane).

As shown by reference number 220, the controller 130 may modify the one or more dynamic track plane parameters, such as by using one or more filters. For example, the controller 130 may apply a filter, of the one or more filters, that corresponds to a dynamic track plane parameter, of the one or more dynamic track plane parameters, to the dynamic track plane parameter. This causes the dynamic track plane parameter to be modified (e.g., as a result of filtering by the applied filter). Accordingly, the dynamic track plane parameter may be referred to as a modified dynamic track plane parameter (or a filtered dynamic track plane parameter).

Each filter, of the one or more filters, may be, for example, a low-pass filter, a high-pass filter, a band-pass filter, or another type of filter. Each filter may be associated with one or more filter coefficients, which the controller 130 may determine. In some implementations, the controller 130 may determine the one or more filter coefficients based on the sensor information (e.g., that was obtained from the one or more sensors 132, as described herein in relation to reference number 214). For example, the controller 130 may process (e.g., parse, read, and/or perform another type of process on) the sensor information to determine a speed of the machine 100, and the controller 130 may determine the one or more filter coefficients based on the speed of the machine 100. In some implementations, the controller 130 may determine the one or more filter coefficients based on a configuration setting of the machine 100. For example, an operator of the machine 100 may interact with the operator controls of the operator station 128 to input the configuration setting (e.g., that indicates the one or more filter coefficients), and the controller 130 may then obtain the configuration setting from the operator station 128 to thereby determine the one or more filter coefficients. Accordingly, the controller 130 may apply a filter to a dynamic track plane parameter (e.g., a filter that corresponds to the dynamic track plane parameter) using the one or more filter coefficients. By making the one or more filter coefficients adaptable (e.g., based on the sensor information and/or the configuration setting), a level of filtering of the dynamic track plane parameter is also adaptable.

As shown in FIG. 2C, and by reference number 222, the controller 130 may determine a dynamic target plane for the implement 112 (e.g., based on the modified one or more dynamic track plane parameters and the plane offset information). For example, the controller 130 may identify a modified plane orientation parameter (e.g., a modified plane Northing angle parameter or a modified plane Easting angle parameter), of the modified one or more dynamic track plane parameters, and a corresponding portion of the plane offset information (e.g., that indicates an angle offset for the modified plane orientation parameter). Accordingly, the controller 130 may determine, based on the modified plane orientation parameter and the corresponding portion of the plane offset information, a plane orientation parameter for the dynamic target plane (e.g., a plane Northing angle parameter or a plane Easting angle parameter for the dynamic target plane), such as by adding (or otherwise combining) the angle offset indicated by the portion of the plane offset information to the modified plane orientation parameter. The controller 130 then may determine the dynamic target plane based on the plane orientation parameter.

As another example, the controller 130 may identify a modified plane elevation parameter (e.g., a modified z coordinate parameter), of the modified one or more dynamic track plane parameters, and a corresponding portion of the plane offset information (e.g., that indicates an elevation offset for the modified plane elevation parameter). Accordingly, the controller 130 may determine, based on the modified plane elevation parameter and the corresponding portion of the plane offset information, an offset-adjusted plane elevation parameter, such as by subtracting (or otherwise combining) the elevation offset indicated by the portion of the plane offset information from the modified plane elevation parameter. The controller 130 then may determine, based on the offset-adjusted plane elevation parameter and a plane elevation parameter, of the one or more reference target plane parameters associated with the reference target plane, a plane origin point elevation parameter, such as by adding (or otherwise combining) the offset-adjusted plane elevation parameter and the plane elevation parameter. The controller 130 then may determine the dynamic target plane based on the plane origin point elevation parameter.

In another example, in addition to determining the plane origin point elevation parameter, the controller 130 may determine at least one plane origin point lateral parameter, such as based on the sensor information (e.g., that was obtained from the one or more sensors 132, as described herein in relation to reference number 214), which may indicate a lateral location (e.g., a ground-level location) of the machine 100 as a combination of x and y coordinate parameters. The controller 130 then may determine the dynamic target plane based on the plane origin point elevation parameter and the at least one plane origin point lateral parameter.

Accordingly, in some implementations, the controller 130 may determine, based on a modified plane elevation parameter, of the modified one or more dynamic track plane parameters, a plane origin point of the dynamic target plane, and may determine, based on at least one modified plane orientation parameter, of the modified one or more dynamic track plane parameters, an orientation of the dynamic target plane. Thus, the controller 130 may determine, based on the plane origin point of the dynamic target plane and the orientation of the dynamic target plane, the dynamic target plane.

As shown by reference number 224, the controller 130 may control the implement 112 based on the dynamic target plane. For example, the controller 130 may determine, based on the dynamic target plane, a target position of the implement 112 (e.g., a position that enables the implement 112 to be aligned with the dynamic target plane). Accordingly, the controller 130 may adjust the implement 112 to achieve the target position. For example, the controller 130 may send one or more control instructions to one or more components of the machine 100, such as the one or more first hydraulic cylinders 120 and/or the one or more second hydraulic cylinders 122, to adjust, lift, lower, or otherwise move and/or position the implement 112 to achieve the target position. In this way, the controller 130 may cause the implement 112 to be aligned with the dynamic target plane.

The controller 130 may repeatedly perform one or more operations described herein in relation to FIGS. 2A-2C, such as at subsequent time (e.g., after controlling the implement 112 based on the dynamic target plane). In this way, the controller 130 may continually determine new dynamic target planes and control the implement 112 to be aligned with the new dynamic target planes. Further, the controller 130 enables a smooth repositioning of the implement 112 by using one or more filters (that utilize adaptive filter coefficients).

As indicated above, FIGS. 2A-2C are provided as an example. Other examples may differ from what is described in connection with FIGS. 2A-2C.

Figure 3A:
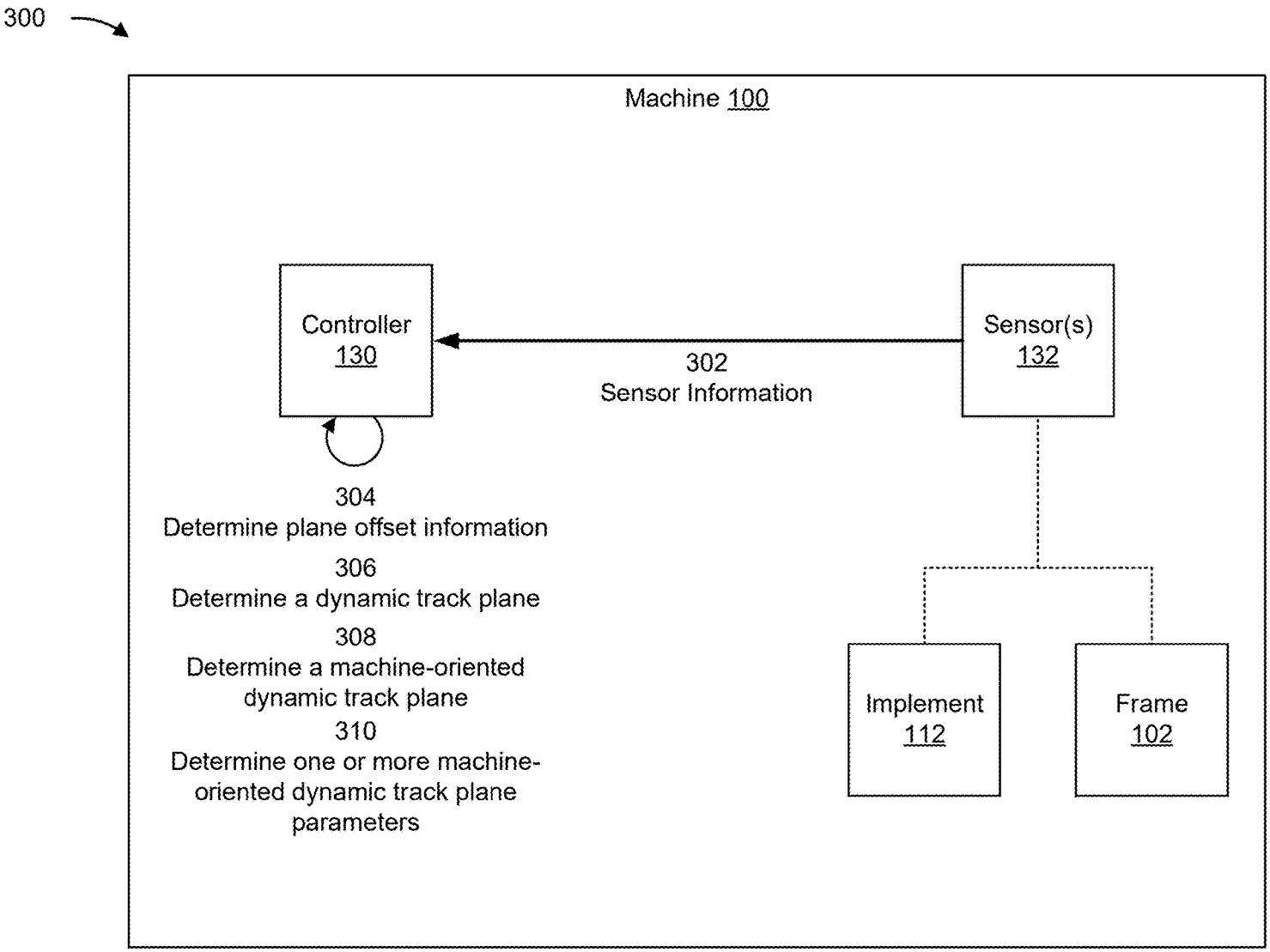
FIGS. 3A-3C are diagrams of an example implementation described herein.
Figure 3B:
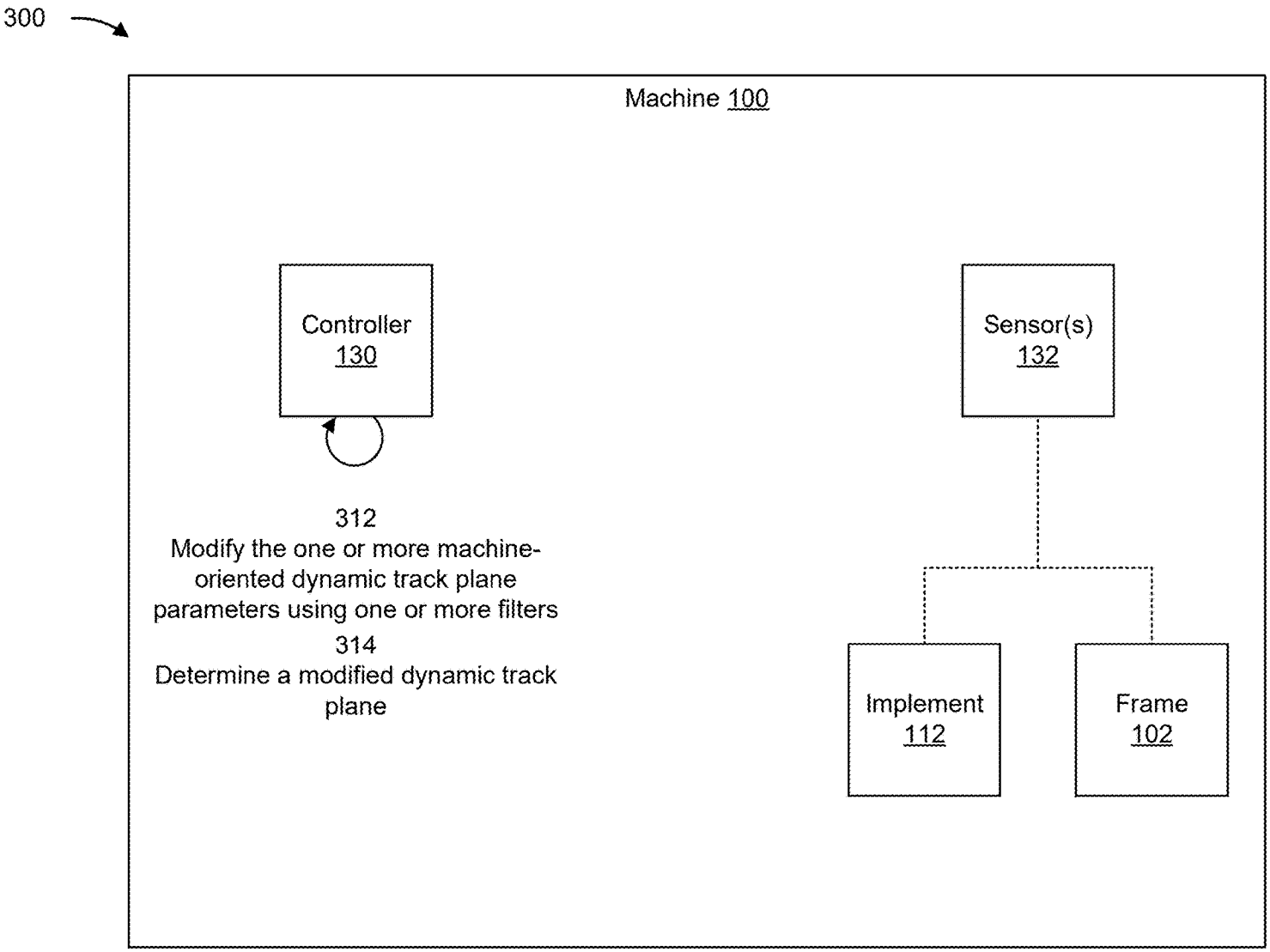
Figure 3C:
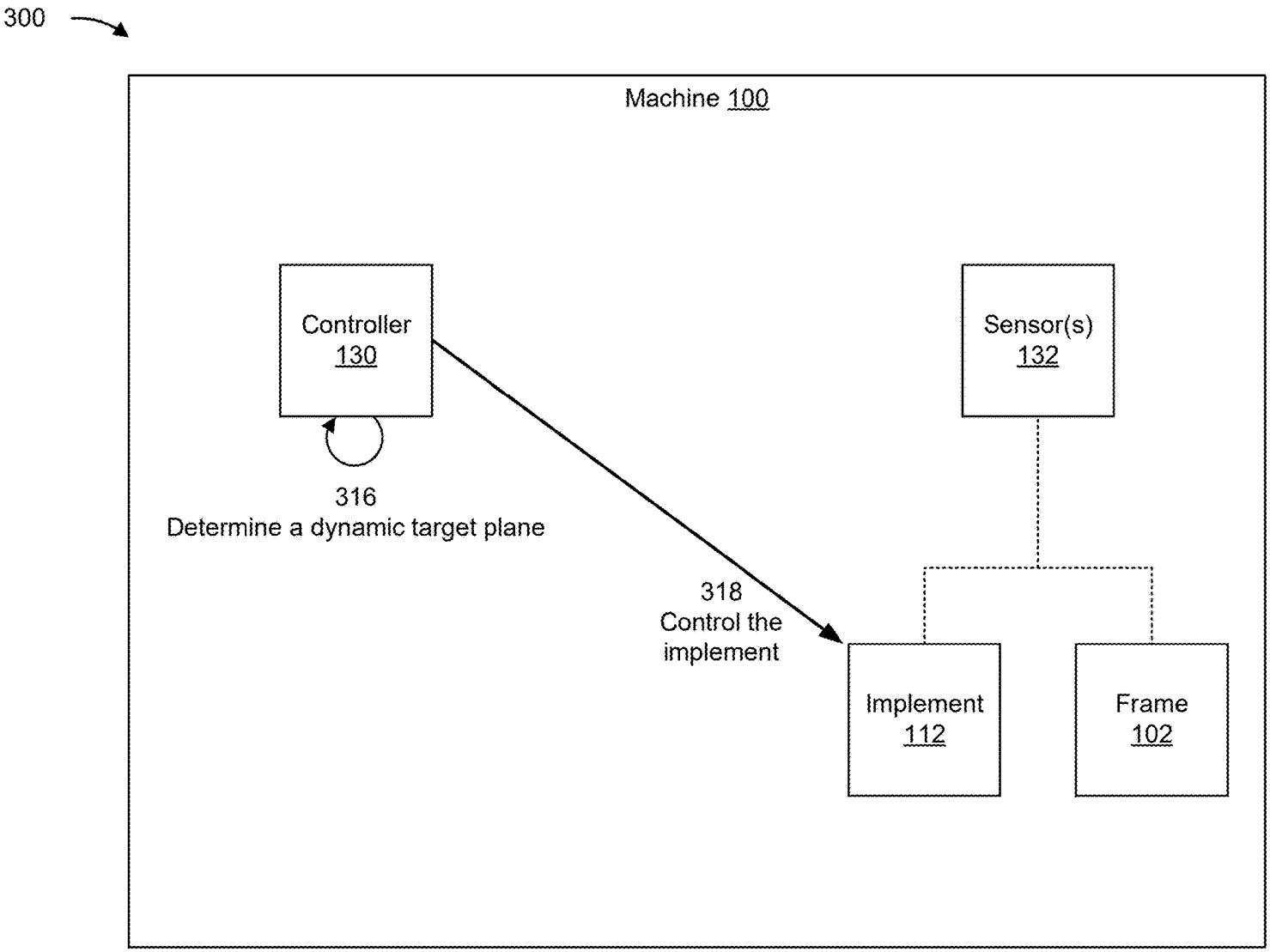

FIGS. 3A-3C are diagrams of an example implementation 300 described herein. FIGS. 3A-3C show how the controller 130 determines a dynamic target plane for an implement 112 (e.g., a blade 114, a ripper 116, or another type of implement) of the machine 100, such as based on filtered machine-oriented dynamic track plane parameters.

As shown in FIG. 3A, and by reference number 302, the controller 130 may obtain sensor information. For example, the controller 130 may obtain the sensor information from the one or more sensors 132, in a similar manner as that described herein in relation to FIG. 2A and reference number 202. The sensor information may indicate, for example, a location (e.g., a physical location) and/or a heading of the machine 100. The location may be represented in global coordinates (e.g., latitude, longitude, and/or elevation), site coordinates (e.g., a Northing, an Easting, and/or an elevation with respect to a local origin point), or other coordinates. Additionally, or alternatively, the sensor information may indicate, for example, a position of the implement 112, which may be represented in global coordinates, site coordinates, or other coordinates, and/or orientation parameters.

As shown by reference number 304, the controller 130 may determine plane offset information, such as in a similar manner as that described herein in relation to FIG. 2A and reference number 212. The plane offset information may be associated with a reference target plane for the implement 112 of the machine (e.g., for when the machine 100 performs an operation), as described herein in relation to FIG. 2A and reference number 204, and a reference track plane of the machine 100, as described herein in relation to FIG. 2A and reference number 208. For example, the controller 130 may determine, and therefore the plane offset information may indicate, respective differences between corresponding plane parameters of one or more reference target plane parameters associated with the reference target plane, as described herein in relation to FIG. 2A and reference number 206, and one or more reference track plane parameters associated with the reference track plane, as described herein in relation to FIG. 2A and reference number 210. In this way, the plane offset information may indicate how to transform (e.g., rotate, translate, reflect, another type of transformation) the reference target plane to align with the reference track plane, or vice versa.

As shown by reference number 306, the controller 130 may determine a dynamic track plane of the machine 100, such as in a similar manner as that described herein in relation to FIG. 2B and reference number 216. The dynamic track plane may be the plane at which the machine 100 is aligned, such as when the machine 100 performs an operation. That is, the dynamic track plane may be a plane at which the machine 100 is aligned during performance of the operation by the machine 100. The controller 130 may determine the dynamic track plane based on the sensor information. For example, the controller 130 may process (e.g., parse, read, and/or perform another type of process on) the sensor information to determine the location and heading of the machine 100, and the controller 130 may determine the dynamic track plane based on the location and heading of the machine 100 (e.g., may define the dynamic track plane as a plane that is aligned with the location and heading of the machine 100).

As shown by reference number 308, the controller 130 may determine a machine-oriented dynamic track plane of the machine 100. That is, the controller 130 may transform the dynamic track plane into a plane that is defined with respect to an orientation frame of the machine 100 (e.g., an orientation frame defined by a heading of the machine 100). For example, the controller 130 may determine, based on the sensor information, a heading of the machine 100. Accordingly, the controller 130 may process, using a transformation technique (e.g., a rotation technique, a translation technique, a reflection technique, or another type of transformation technique) and based on the heading of the machine, the dynamic track plane to determine the machine-oriented dynamic track plane.

As shown by reference number 310, the controller 130 may determine one or more machine-oriented dynamic track plane parameters associated with the machine-oriented dynamic track plane. The one or more machine-oriented dynamic track plane parameters may include one or more machine-oriented plane orientation parameters, such as a machine-oriented plane mainfall angle parameter (e.g., that indicates a mainfall angle of the machine 100) and/or a machine-oriented plane sideslope angle parameter (e.g., that indicates a sideslope angle of the machine 100), and/or a machine-oriented plane elevation parameter (e.g., that indicates an elevation of the machine 100). The controller 130 may determine the one or more machine-oriented dynamic track plane parameters based on the sensor information (e.g., in association with determining the machine-oriented dynamic track plane, or as an alternative to determining the machine-oriented dynamic track plane).

As shown in FIG. 3B, and by reference number 312, the controller 130 may modify the one or more machine-oriented dynamic track plane parameters, such as by using one or more filters. For example, the controller 130 may apply a filter, of the one or more filters, that corresponds to a machine-oriented dynamic track plane parameter, of the one or more machine-oriented dynamic track plane parameters, to the machine-oriented dynamic track plane parameter. This causes the machine-oriented dynamic track plane parameter to be modified (e.g., as a result of filtering by the applied filter). Accordingly, the machine-oriented dynamic track plane parameter may be referred to as a modified machine-oriented dynamic track plane parameter (or a filtered machine-oriented dynamic track plane parameter).

Each filter, of the one or more filters, may be, for example, a low-pass filter, a high-pass filter, a band-pass filter, or another type of filter. Each filter may be associated with one or more filter coefficients, which the controller 130 may determine. In some implementations, the controller 130 may determine the one or more filter coefficients based on the sensor information (e.g., that was obtained from the one or more sensors 132, as described herein in relation to reference number 214). For example, the controller 130 may process (e.g., parse, read, and/or perform another type of process on) the sensor information to determine a speed of the machine 100, and the controller 130 may determine the one or more filter coefficients based on the speed of the machine 100. In some implementations, the controller 130 may determine the one or more filter coefficients based on a configuration setting of the machine 100. For example, an operator of the machine 100 may interact with the operator controls of the operator station 128 to input the configuration setting (e.g., that indicates the one or more filter coefficients), and the controller 130 may then obtain the configuration setting from the operator station 128 to thereby determine the one or more filter coefficients. Accordingly, the controller 130 may apply a filter to a machine-oriented dynamic track plane parameter (e.g., a filter that corresponds to the machine-oriented dynamic track plane parameter) using the one or more filter coefficients. By making the one or more filter coefficients adaptable (e.g., based on the sensor information and/or the configuration setting), a level of filtering of the machine-oriented dynamic track plane parameter is also adaptable.

In some implementations, the controller 130 may use different sets of filter coefficients for filtering different machine-oriented dynamic track plane parameters. For example, the controller 130 may apply a first low-pass filter, of the one or more filters, to a first machine-oriented dynamic track plane parameter, of the one or more machine-oriented dynamic track plane parameters, using one or more first filter coefficients, and may apply a second low-pass filter, of the one or more filters, to a second machine-oriented dynamic track plane parameter, of the one or more machine-oriented dynamic track plane parameters, using one or more second filter coefficients that are different than the one or more first filter coefficients (e.g., at least one filter coefficient of the one or more second filter coefficients is not included in the one or more first filter coefficients, or vice versa). In this way, the controller 130 may provide different levels of filtering within the machine-oriented domain, such as a first level of filtering in the machine-oriented mainfall angle domain and a second, different level of filtering in the machine-oriented sideslope angle domain.

As shown by reference number 314, the controller 130 may determine a modified dynamic track plane of the machine 100. That is, the controller 130 may transform a modified machine-oriented dynamic track plane (e.g., as defined by the modified one or more machine-oriented dynamic track plane parameters) into a plane that is defined with respect to an original orientation frame (e.g., an orientation frame defined by global coordinates, site coordinates, or other coordinates). For example, the controller 130 may determine, based on the sensor information, a heading of the machine 100 and may determine, based on the modified one or more machine-oriented dynamic track plane parameters, a modified machine-oriented dynamic track plane. Accordingly, the controller 130 may process, using a transformation technique (e.g., a rotation technique, a translation technique, a reflection technique, or another type of transformation technique) and based on the heading of the machine, the modified machine-oriented dynamic track plane to determine the modified dynamic track plane.

As shown in FIG. 3C, and by reference number 316, the controller 130 may determine a dynamic target plane for the implement 112 (e.g., based on the modified dynamic track plane and the plane offset information), such as in a similar manner as that described herein in relation to FIG. 2C and reference number 222. For example, the controller 130 may determine modified one or more dynamic track plane parameters associated with the modified dynamic track plane and may identify a modified plane orientation parameter (e.g., a modified plane Northing angle parameter or a modified plane Easting angle parameter), of the modified one or more dynamic track plane parameters, and a corresponding portion of the plane offset information (e.g., that indicates an angle offset for the modified plane orientation parameter). Accordingly, the controller 130 may determine, based on the modified plane orientation parameter and the corresponding portion of the plane offset information, a plane orientation parameter for the dynamic target plane (e.g., a plane Northing angle parameter or a plane Easting angle parameter for the dynamic target plane), such as by adding (or otherwise combining) the angle offset indicated by the portion of the plane offset information to the modified plane orientation parameter. The controller 130 then may determine the dynamic target plane based on the plane orientation parameter.

As shown by reference number 318, the controller 130 may control the implement 112 based on the dynamic target plane, such as in a similar manner as that described herein in relation to FIG. 2C and reference number 224. For example, the controller 130 may determine, based on the dynamic target plane, a target position of the implement 112 (e.g., a position that enables the implement 112 to be aligned with the dynamic target plane). Accordingly, the controller 130 may adjust the implement 112 to achieve the target position. For example, the controller 130 may send one or more control instructions to one or more components of the machine 100, such as the one or more first hydraulic cylinders 120 and/or the one or more second hydraulic cylinders 122, to adjust, lift, lower, or otherwise move and/or position the implement 112 to achieve the target position. In this way, the controller 130 may cause the implement 112 to be aligned with the dynamic target plane.

The controller 130 may repeatedly perform one or more operations described herein in relation to FIGS. 3A-3C, such as at subsequent time (e.g., after controlling the implement 112 based on the dynamic target plane). In this way, the controller 130 may continually determine new dynamic target planes and control the implement 112 to be aligned with the new dynamic target planes. Further, the controller 130 enables a smooth repositioning of the implement 112 by using one or more filters (that utilize adaptive filter coefficients). Additionally, because the one or more machine-oriented dynamic track plane parameters are filtered, the smoothness of the repositioning of the implement 112 is controlled within a machine-oriented domain.

As indicated above, FIGS. 3A-3C are provided as an example. Other examples may differ from what is described in connection with FIGS. 3A-3C.

Figure 4A:
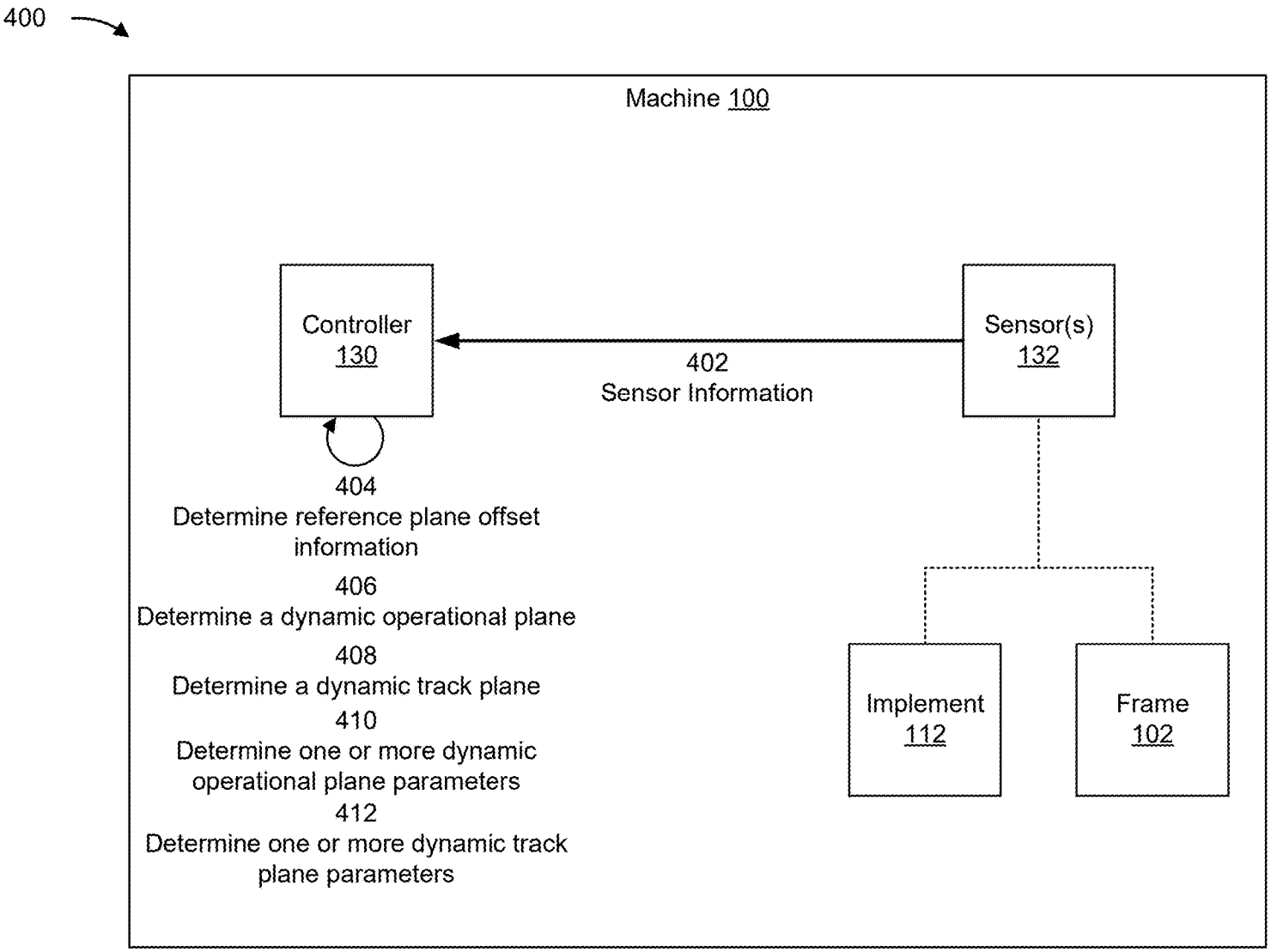
FIGS. 4A-4C are diagrams of an example implementation described herein.
Figure 4B:
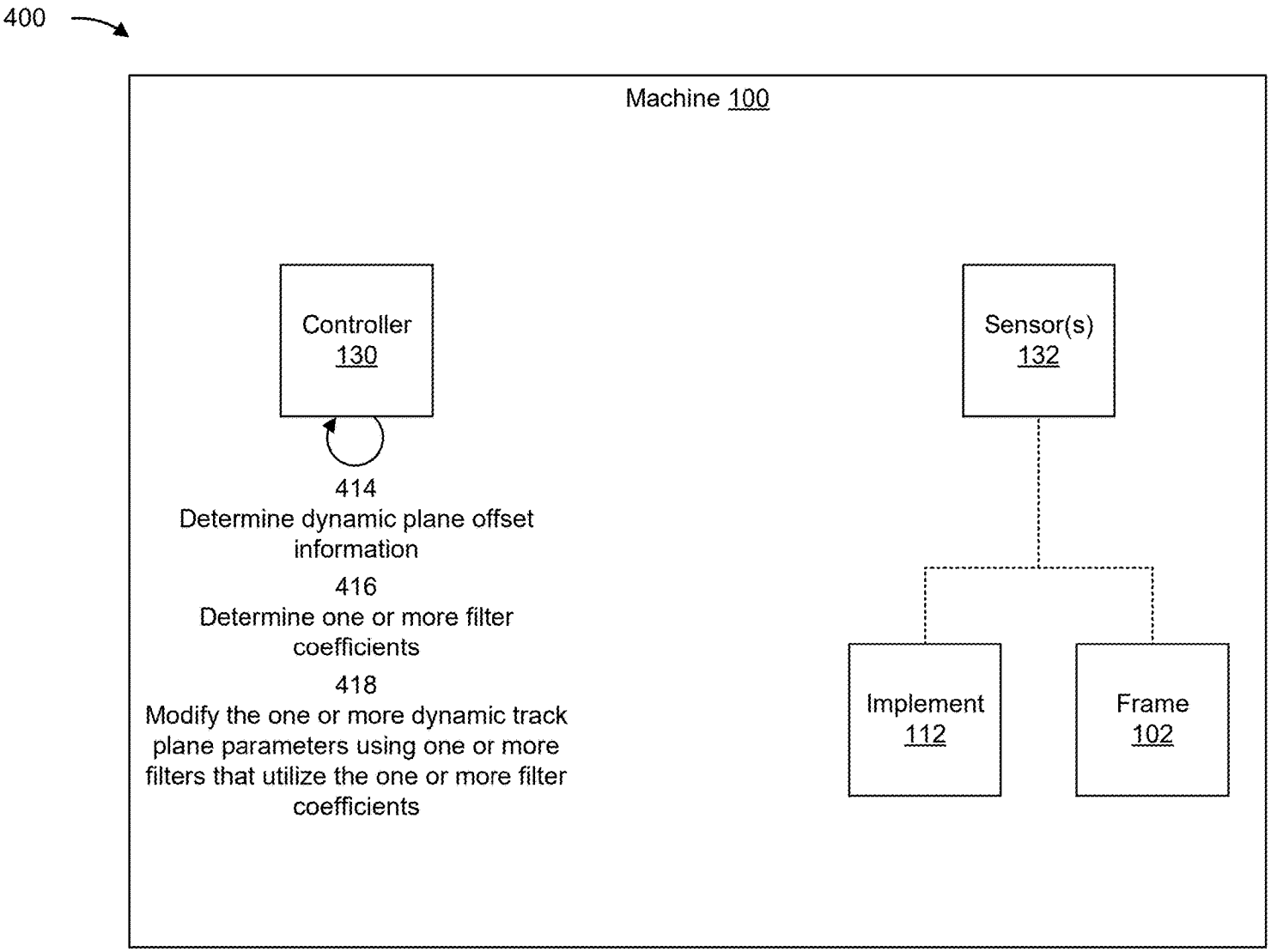
Figure 4C:
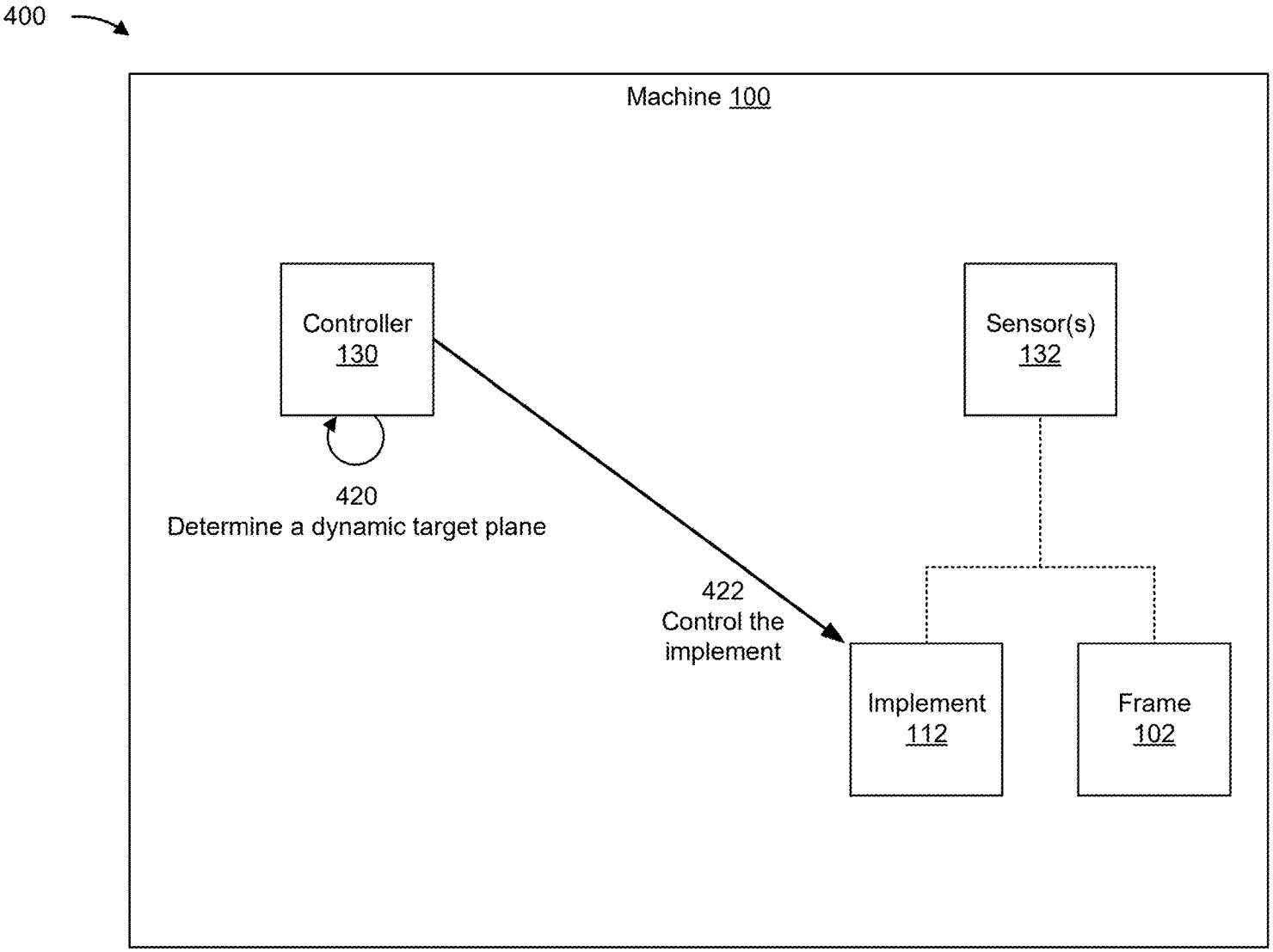

FIGS. 4A-4C are diagrams of an example implementation 400 described herein. FIGS. 4A-4C show how the controller 130 determines filter coefficients for filtering dynamic track plane parameters to determine a dynamic target plane for an implement 112 (e.g., a blade 114, a ripper 116, or another type of implement) of the machine 100.

As shown in FIG. 4A, and by reference number 402, the controller 130 may obtain sensor information. For example, the controller 130 may obtain the sensor information from the one or more sensors 132, in a similar manner as that described herein in relation to FIG. 2A and reference number 202. The sensor information may indicate, for example, a location (e.g., a physical location) and/or a heading of the machine 100. The location may be represented in global coordinates (e.g., latitude, longitude, and/or elevation), site coordinates (e.g., a Northing, an Easting, and/or an elevation with respect to a local origin point), or other coordinates. Additionally, or alternatively, the sensor information may indicate, for example, a position of the implement 112, which may be represented in global coordinates, site coordinates, or other coordinates, and/or orientation parameters.

As shown by reference number 404, the controller 130 may determine reference plane offset information, such as in a similar manner as that described herein in relation to FIG. 2A and reference number 212. The reference plane offset information may be associated with a reference target plane for the implement 112 of the machine (e.g., for when the machine 100 performs an operation), as described herein in relation to FIG. 2A and reference number 204, and a reference track plane of the machine 100, as described herein in relation to FIG. 2A and reference number 208. For example, the controller 130 may determine, and therefore the reference plane offset information may indicate, respective differences between corresponding plane parameters of one or more reference target plane parameters associated with the reference target plane, as described herein in relation to FIG. 2A and reference number 206, and one or more reference track plane parameters associated with the reference track plane, as described herein in relation to FIG. 2A and reference number 210. In this way, the reference plane offset information may indicate how to transform (e.g., rotate, translate, reflect, another type of transformation) the reference target plane to align with the reference track plane, or vice versa.

As shown by reference number 406, the controller 130 may determine a dynamic operational plane of the implement 112. The dynamic operational plane may be a plane at which the implement 112 (or a portion of the implement, such as an edge of the implement 112) is aligned, such as when the machine 100 performs the operation, such as to enable a desired work result. For example, when the implement 112 is a blade (e.g., the blade 114), the dynamic operational plane may be a plane at which the implement 112 is aligned to cause a ground surface, which is being worked on by performance of a dozing operation by the machine 100, to be leveled or sloped. The controller 130 may determine the dynamic operational plane based on the sensor information. For example, the controller 130 may process (e.g., parse, read, and/or perform another type of process on) the sensor information to determine the position of the implement 112, and the controller 130 may determine the dynamic operational plane based on the position of the implement 112 (e.g., may define the dynamic operational plane as a plane that is aligned with the position of the implement 112).

As shown by reference number 408, the controller 130 may determine a dynamic track plane of the machine 100, such as in a similar manner as that described herein in relation to FIG. 2B and reference number 216. The dynamic track plane may be the plane at which the machine 100 is aligned, such as when the machine 100 performs an operation. That is, the dynamic track plane may be a plane at which the machine 100 is aligned during performance of the operation by the machine 100. The controller 130 may determine the dynamic track plane based on the sensor information. For example, the controller 130 may process (e.g., parse, read, and/or perform another type of process on) the sensor information to determine the location and heading of the machine 100, and the controller 130 may determine the dynamic track plane based on the location and heading of the machine 100 (e.g., may define the dynamic track plane as a plane that is aligned with the location and heading of the machine 100).

As shown by reference number 410, the controller 130 may determine one or more dynamic operational plane parameters associated with the dynamic track plane. The one or more dynamic operational plane parameters may include one or more plane orientation parameters, such as a plane Northing angle parameter (e.g., that indicates an angle between a +y axis of a coordinate system that represents the position of the implement 112 and an intersection of the dynamic operational plane and an xz plane of the coordinate system) and/or a plane Easting angle parameter (e.g., that indicates an angle between a +x axis of the coordinate system that represents the position of the implement 112 and an intersection of the dynamic operational plane and an yz plane of the coordinate system), and/or a plane elevation parameter (e.g., that indicates a z coordinate, of the coordinate system that represents the position of the implement 112, of an origin point of the dynamic operational plane). The controller 130 may determine the one or more dynamic operational plane parameters based on the sensor information (e.g., in association with determining the dynamic operational plane, or as an alternative to determining the dynamic operational plane).

As shown by reference number 412, the controller 130 may determine one or more dynamic track plane parameters associated with the dynamic track plane. The one or more dynamic track plane parameters may include one or more plane orientation parameters, such as a plane Northing angle parameter (e.g., that indicates an angle between a +y axis of a coordinate system that represents the location and heading of the machine 100 and an intersection of the dynamic track plane and an xz plane of the coordinate system) and/or a plane Easting angle parameter (e.g., that indicates an angle between a +x axis of the coordinate system that represents the location and heading of the machine 100 and an intersection of the dynamic track plane and an yz plane of the coordinate system), and/or a plane elevation parameter (e.g., that indicates a z coordinate, of the coordinate system that represents the location and heading of the machine 100, of an origin point of the dynamic track plane). The controller 130 may determine the one or more dynamic track plane parameters based on the sensor information (e.g., in association with determining the dynamic track plane, or as an alternative to determining the dynamic track plane).

As shown in FIG. 4B, and by reference number 414, the controller 130 may determine dynamic plane offset information. The dynamic plane offset information may be associated with the dynamic operational plane of the implement 112 and the dynamic track plane of the machine 100. For example, the controller 130 may determine, and therefore the dynamic plane offset information may indicate, respective differences between corresponding plane parameters of the one or more dynamic operational plane parameters associated with the dynamic operational plane and the one or more dynamic track plane parameters associated with the dynamic track plane. In this way, the dynamic plane offset information may indicate how to transform (e.g., rotate, translate, reflect, another type of transformation) the dynamic operational plane to align with the dynamic track plane, or vice versa.

As shown by reference number 416, the controller 130 may determine one or more filter coefficients. In some implementations, the controller 130 may determine the one or more filter coefficients based on the sensor information (e.g., that was obtained from the one or more sensors 132, as described herein in relation to reference number 214). For example, the controller 130 may process (e.g., parse, read, and/or perform another type of process on) the sensor information to determine a speed of the machine 100, and the controller 130 may determine the one or more filter coefficients based on the speed of the machine 100. In some implementations, the controller 130 may determine the one or more filter coefficients based on a configuration setting of the machine 100. For example, an operator of the machine 100 may interact with the operator controls of the operator station 128 to input the configuration setting (e.g., that indicates the one or more filter coefficients), and the controller 130 may then obtain the configuration setting from the operator station 128 to thereby determine the one or more filter coefficients.

In some implementations, the controller 130 may determine the one or more filter coefficients based on the dynamic plane offset information and at least one of the configuration setting of the machine 100 or the sensor information. For example, when a magnitude of the differences between corresponding plane parameters indicated by the dynamic plane offset information is large, the controller 130 may increase a magnitude of a filter coefficient determined based on the configuration setting of the machine 100 or the sensor information. As another example, when a magnitude of the differences between corresponding plane parameters indicated by the dynamic plane offset information is small, the controller 130 may decrease a magnitude of a filter coefficient determined based on the configuration setting of the machine 100 or the sensor information.

In some implementations, the controller 130 may determine, based on the dynamic plane offset information and historical dynamic plane offset information (e.g., that was previously determined by the controller 130), dynamic plane offset rate of change information (e.g., that indicates how quickly differences between corresponding plane parameters indicated by the dynamic plane offset information change over time). Accordingly, the controller 130 may determine, based on the dynamic plane offset rate of change information, the one or more filter coefficients. For example, when the dynamic plane offset rate of change information indicates a high rate of change, the controller 130 may determine a filter coefficient with a high value. As another example, when the dynamic plane offset rate of change information indicates a low rate of change, the controller 130 may determine a filter coefficient with a low value.

In some implementations, the controller 130 may obtain terrain information associated with a site where the machine performs the operation, such as from a data storage device included in the machine 100 or communicated to the machine 100 from another device (e.g., a site monitoring device). The terrain information may indicate, for example, a slope of the site, a topography of the site, a surface composition (e.g., sand, rock, dirt, along with other examples) of the site, a surface density of the site, a surface roughness of the site, a moisture level of the site, weather conditions associated with the site, and/or locations of obstacles at the site, along with other examples. Alternatively, the controller 130 may determine the terrain information based on sensor information obtained from the one or more sensors 132 of the machine (e.g., by processing the sensor information). Accordingly, the controller 130 may determine predicted dynamic plane offset information based on the dynamic plane offset information and the terrain information. The predicted dynamic plane offset information may indicate a prediction of the dynamic plane offset information that is to be determined by the controller 130 when traversing the site with the terrain indicated by the terrain information. The controller 130 then may determine the one or more filter coefficients based on the dynamic plane offset information and the predicted dynamic plane offset information. For example, when magnitudes of the differences between corresponding plane parameters indicated by the dynamic plane offset information and the predicted dynamic plane offset information is large, the controller 130 may determine a filter coefficient with a high value. As another example, when a magnitude of the differences between corresponding plane parameters indicated by the dynamic plane offset information and the predicted dynamic plane offset information is small, the controller 130 may determine a filter coefficient with a low value.

As shown by reference number 418, the controller 130 may modify the one or more dynamic track plane parameters, such as by using one or more filters that utilize the one or more filter coefficients. Each filter, of the one or more filters, may be, for example, a low-pass filter, a high-pass filter, a band-pass filter, or another type of filter. For example, the controller 130 may apply a filter, of the one or more filters, that corresponds to a dynamic track plane parameter, of the one or more dynamic track plane parameters, to the dynamic track plane parameter using at least one of the one or more filter coefficients. By making the one or more filter coefficients adaptable (e.g., based on the sensor information and/or the configuration setting), a level of filtering of the dynamic track plane parameter is also adaptable. This causes the dynamic track plane parameter to be modified (e.g., as a result of filtering by the applied filter). Accordingly, the dynamic track plane parameter may be referred to as a modified dynamic track plane parameter (or a filtered dynamic track plane parameter).

In some implementations, the controller 130 may use different sets of filter coefficients for filtering different dynamic track plane parameters. For example, the controller 130 may apply a first low-pass filter, of the one or more filters, to a first dynamic track plane parameter, of the one or more dynamic track plane parameters, using a first set of one or more filter coefficients of the one or more filter coefficients, and may apply a second low-pass filter, of the one or more filters, to a second dynamic track plane parameter, of the one or more dynamic track plane parameters, using a second set of one or more filter coefficients, of the one or more filter coefficients, that is different than the first set of one or more filter coefficients.

As shown in FIG. 4C, and by reference number 420, the controller 130 may determine a dynamic target plane for the implement 112 (e.g., based on the modified one or more dynamic track plane parameters and the reference plane offset information), such as in a similar manner as that described herein in relation to FIG. 2C and reference number 222. For example, the controller 130 may identify a modified plane orientation parameter (e.g., a modified plane Northing angle parameter or a modified plane Easting angle parameter), of the modified one or more dynamic track plane parameters, and a corresponding portion of the plane offset information (e.g., that indicates an angle offset for the modified plane orientation parameter). Accordingly, the controller 130 may determine, based on the modified plane orientation parameter and the corresponding portion of the plane offset information, a plane orientation parameter for the dynamic target plane (e.g., a plane Northing angle parameter or a plane Easting angle parameter for the dynamic target plane), such as by adding (or otherwise combining) the angle offset indicated by the portion of the plane offset information to the modified plane orientation parameter. The controller 130 then may determine the dynamic target plane based on the plane orientation parameter.

As shown by reference number 422, the controller 130 may control the implement 112 based on the dynamic target plane, such as in a similar manner as that described herein in relation to FIG. 2C and reference number 224. For example, the controller 130 may determine, based on the dynamic target plane, a target position of the implement 112 (e.g., a position that enables the implement 112 to be aligned with the dynamic target plane). Accordingly, the controller 130 may adjust the implement 112 to achieve the target position. For example, the controller 130 may send one or more control instructions to one or more components of the machine 100, such as the one or more first hydraulic cylinders 120 and/or the one or more second hydraulic cylinders 122, to adjust, lift, lower, or otherwise move and/or position the implement 112 to achieve the target position. In this way, the controller 130 may cause the implement 112 to be aligned with the dynamic target plane.

The controller 130 may repeatedly perform one or more operations described herein in relation to FIGS. 4A-4C, such as at subsequent time (e.g., after controlling the implement 112 based on the dynamic target plane). In this way, the controller 130 may continually determine new dynamic target planes and control the implement 112 to be aligned with the new dynamic target planes. Further, the controller 130 enables a smooth repositioning of the implement 112 by using one or more filters (that utilize adaptive filter coefficients).

As indicated above, FIGS. 4A-4C are provided as an example. Other examples may differ from what is described in connection with FIGS. 4A-4C.

Figure 5:
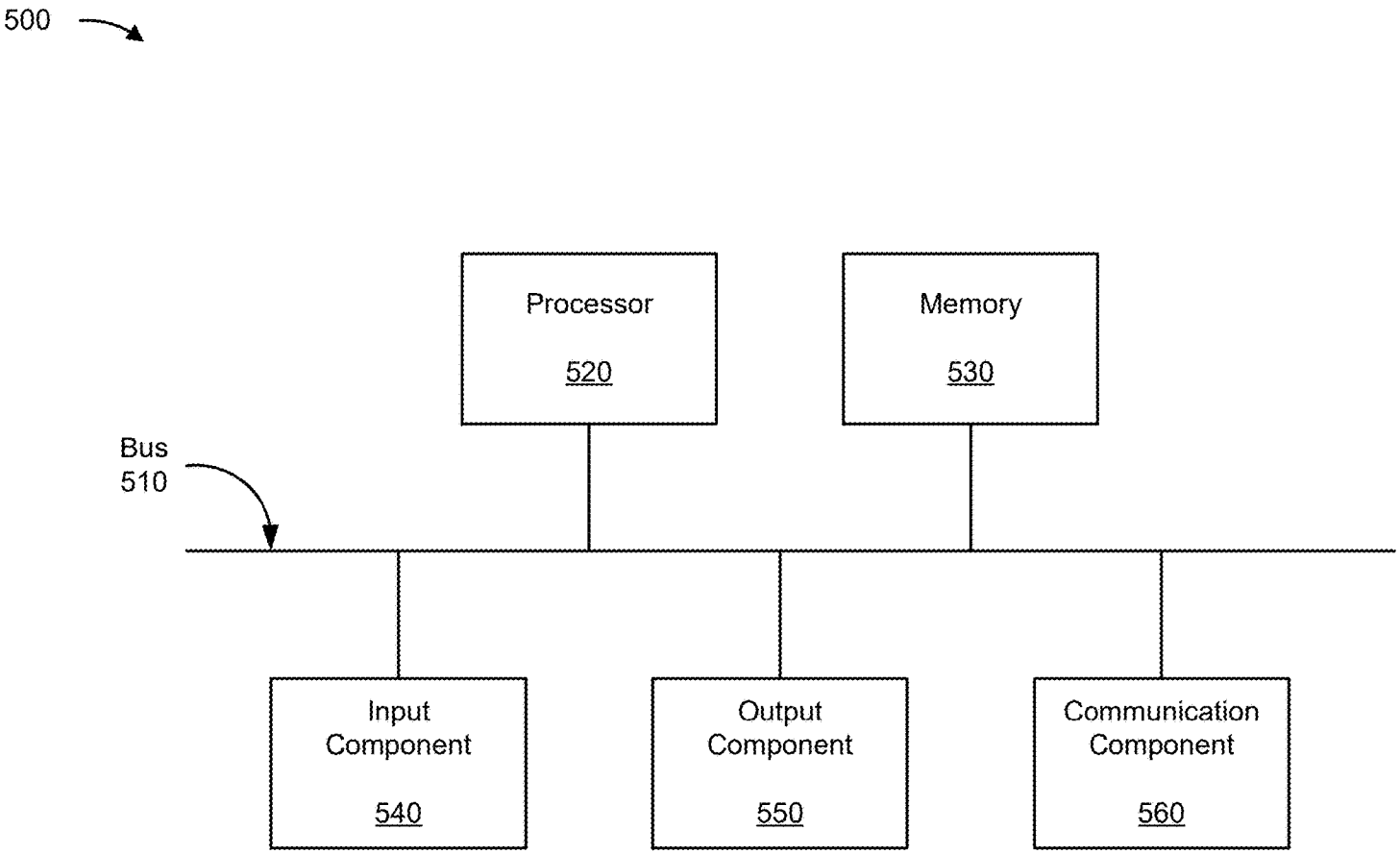
FIG. 5 is a diagram of example components of a device associated with determination of a dynamic target plane for an implement of a machine.

FIG. 5 is a diagram of example components of a device 500 associated with determination of a dynamic target plane for an implement of a machine. The device 500 may correspond to the controller 130, the one or more sensors 132, and/or one or more other components of the machine 100. In some implementations, the controller 130, the one or more sensors 132, and/or one or more other components of the machine 100 may include one or more devices 500 and/or one or more components of the device 500. As shown in FIG. 5, the device 500 may include a bus 510, a processor 520, a memory 530, an input component 540, an output component 550, and/or a communication component 560.

The bus 510 may include one or more components that enable wired and/or wireless communication among the components of the device 500. The bus 510 may couple together two or more components of FIG. 5, such as via operative coupling, communicative coupling, electronic coupling, and/or electric coupling. For example, the bus 510 may include an electrical connection (e.g., a wire, a trace, and/or a lead) and/or a wireless bus. The processor 520 may include a central processing unit, a graphics processing unit, a microprocessor, a controller, a microcontroller, a digital signal processor, a field-programmable gate array, an application-specific integrated circuit, and/or another type of processing component. The processor 520 may be implemented in hardware, firmware, or a combination of hardware and software. In some implementations, the processor 520 may include one or more processors capable of being programmed to perform one or more operations or processes described elsewhere herein.

The memory 530 may include volatile and/or nonvolatile memory. For example, the memory 530 may include random access memory (RAM), read only memory (ROM), a hard disk drive, and/or another type of memory (e.g., a flash memory, a magnetic memory, and/or an optical memory). The memory 530 may include internal memory (e.g., RAM, ROM, or a hard disk drive) and/or removable memory (e.g., removable via a universal serial bus connection). The memory 530 may be a non-transitory computer-readable medium. The memory 530 may store information, one or more instructions, and/or software (e.g., one or more software applications) related to the operation of the device 500. In some implementations, the memory 530 may include one or more memories that are coupled (e.g., communicatively coupled) to one or more processors (e.g., processor 520), such as via the bus 510. Communicative coupling between a processor 520 and a memory 530 may enable the processor 520 to read and/or process information stored in the memory 530 and/or to store information in the memory 530.

The input component 540 may enable the device 500 to receive input, such as user input and/or sensed input. For example, the input component 540 may include a touch screen, a keyboard, a keypad, a mouse, a button, a microphone, a switch, a sensor, a global positioning system sensor, a global navigation satellite system sensor, an accelerometer, a gyroscope, and/or an actuator. The output component 550 may enable the device 500 to provide output, such as via a display, a speaker, and/or a light-emitting diode. The communication component 560 may enable the device 500 to communicate with other devices via a wired connection and/or a wireless connection. For example, the communication component 560 may include a receiver, a transmitter, a transceiver, a modem, a network interface card, and/or an antenna.

The device 500 may perform one or more operations or processes described herein. For example, a non-transitory computer-readable medium (e.g., memory 530) may store a set of instructions (e.g., one or more instructions or code) for execution by the processor 520. The processor 520 may execute the set of instructions to perform one or more operations or processes described herein. In some implementations, execution of the set of instructions, by one or more processors 520, causes the one or more processors 520 and/or the device 500 to perform one or more operations or processes described herein. In some implementations, hardwired circuitry may be used instead of or in combination with the instructions to perform one or more operations or processes described herein. Additionally, or alternatively, the processor 520 may be configured to perform one or more operations or processes described herein. Thus, implementations described herein are not limited to any specific combination of hardware circuitry and software.

The number and arrangement of components shown in FIG. 5 are provided as an example. The device 500 may include additional components, fewer components, different components, or differently arranged components than those shown in FIG. 5. Additionally, or alternatively, a set of components (e.g., one or more components) of the device 500 may perform one or more functions described as being performed by another set of components of the device 500.

INDUSTRIAL APPLICABILITY

Implementations described herein may be used with any machine that includes a controller and an implement, such as a dozer that includes a controller and a blade. The machine may be any machine that performs an operation associated with an industry such as, for example, mining, construction, farming, transportation, or any other industry.

To achieve a desired outcome of a machine's operation, it is often necessary to align the machine's implement with a target plane during performance of the operation. For example, when the machine is a dozer equipped with a blade, aligning the blade with a target plane ensures that the work surface is leveled or graded according to specified requirements. However, when the machine moves over an uneven work surface, changes in the machine's track plane can cause unintended movement of the implement. This makes it difficult to keep the implement consistently aligned with the target plane during operation. Additionally, while maintaining alignment with the target plane is ideal, attempting to rigidly readjust the implement to match the target plane often results in choppy movements. These movements can compromise the quality of the outcome of the work operation. For example, as a dozer moves over a bumpy surface that frequently alters the machine's track plane, the machine's blade is repeatedly repositioned to compensate, leading to an uneven or washboard work surface. Further, because of the compromised quality of the outcome of the work operation, the machine often has to reperform the operation to provide an outcome with improved quality. This decreases a productivity of the machine and increases wear and tear on the implement and the machine, which reduces an operable life of the implement and the machine.

Some implementations described herein include a controller of a machine that determines a dynamic target plane for an implement of the machine. The dynamic target plane can be used to control the implement so that the implement is repositioned in a "smooth" manner while still being generally aligned with the reference target plane (e.g., being aligned with the target plane within a threshold). When the machine is a dozer performing a dozing operation, and the implement is a blade, this results in a smooth dozed surface even when the underlying terrain is bumpy or undulating. Further, the implementations automatically enable the smooth repositioning of the implement, which improves a productivity of the machine (e.g., by reducing a number of passes needed to achieve a smooth surface). This then results in reduced wear and tear on the implement and the machine, which increases an operable life of the implement and the machine.

In some implementations, the controller determines offset information associated with a reference target plane for the implement of the machine and a reference track plane of the machine (e.g., before the machine performs an operation). The controller then determines, when the machine performs the operation, a dynamic track plane of the machine. The controller determines dynamic track plane parameters associated with the dynamic track plane and applies a filter thereto to ensure a "smoothness" of the dynamic track plane parameters. The controller then uses the dynamic track plane parameters to calculate the dynamic target plane for the implement (e.g., based on the offset information) and controls the implement based on the dynamic target plane. This enables a smooth repositioning of the implement.

In some implementations, the controller determines offset information associated with a reference target plane for the implement of the machine and a reference track plane of the machine (e.g., before the machine performs the operation). The controller then determines, when the machine performs the operation, a dynamic track plane of the machine. The controller transforms the dynamic track plane into a machine-oriented dynamic track plane (e.g., that is defined by a heading of the machine) and determines machine-oriented dynamic track plane parameters associated with the machine-oriented dynamic track plane. The controller then applies a filter thereto to ensure a smoothness of the dynamic track plane parameters. In this way, the controller provides different levels of filtering within the machine-oriented domain, such as a first level of filtering in a machine-oriented mainfall angle domain and a second, different level of filtering in a machine-oriented sideslope angle domain, which would not otherwise be feasible.

The controller uses the filtered machine-oriented dynamic track plane parameters to calculate a filtered dynamic track plane of the machine. The controller then determines the dynamic target plane for the implement (e.g., based on the offset information) and controls the implement based on the dynamic target plane. This enables a smooth repositioning of the implement. Additionally, because the one or more machine-oriented dynamic track plane parameters are filtered, the smoothness of the repositioning of the implement is controlled within a machine-oriented domain, which would not otherwise be feasible.

In some implementations, the controller determines reference plane offset information associated with a reference target plane for the implement of the machine and a reference track plane of the machine (e.g., before the machine performs an operation). The controller then determines, when the machine performs the operation, a dynamic operational plane of the implement and a dynamic track plane of the machine. The controller determines dynamic plane offset information associated with the dynamic operation plane and the dynamic track plane, which the controller uses to determine filter coefficients. In this way, the filter coefficients are adaptable (e.g., based on real-time operation of the machine). The controller then filters dynamic track plane parameters of the dynamic track plane using the filter coefficients to ensure a smoothness of the dynamic track plane parameters. The controller then uses the dynamic track plane parameters to calculate the dynamic target plane for the implement (e.g., based on the offset information) and controls the implement based on the dynamic target plane. This enables a smooth repositioning of the implement. Further, by using adaptable filter coefficients, a level of filtering of the dynamic track plane parameter is also adaptable.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

When "a processor" or "one or more processors" (or another device or component, such as "a controller" or "one or more controllers") is described or claimed (within a single claim or across multiple claims) as performing multiple operations or being configured to perform multiple operations, this language is intended to broadly cover a variety of processor architectures and environments. For example, unless explicitly claimed otherwise (e.g., via the use of "first processor" and "second processor" or other language that differentiates processors in the claims), this language is intended to cover a single processor performing or being configured to perform all of the operations, a group of processors collectively performing or being configured to perform all of the operations, a first processor performing or being configured to perform a first operation and a second processor performing or being configured to perform a second operation, or any combination of processors performing or being configured to perform the operations. For example, when a claim has the form "one or more processors configured to: perform X; perform Y; and perform Z," that claim should be interpreted to mean "one or more processors configured to perform X; one or more (possibly different) processors configured to perform Y; and one or more (also possibly different) processors configured to perform Z."

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A machine, comprising:

an implement; and a controller configured to:

determine a reference target plane for the implement for when the machine performs an operation;

determine one or more reference target plane parameters associated with the reference target plane;

determine one or more reference track plane parameters associated with a reference track plane of the machine;

determine, based on the one or more reference target plane parameters and the one or more reference track plane parameters, plane offset information;

determine, when the machine performs the operation, a dynamic track plane of the machine;

determine one or more dynamic track plane parameters associated with the dynamic track plane;

modify, using one or more filters, the one or more dynamic track plane parameters;

determine, based on the modified one or more dynamic track plane parameters and the plane offset information, a dynamic target plane for the implement; and control the implement based on the dynamic target plane.

2. The machine of claim 1, wherein each of the one or more reference target plane parameters, the one or more reference track plane parameters, and the one or more dynamic track plane parameters includes at least one of:

one or more plane orientation parameters;

one or more plane polar coordinate parameters; or one or more normal vector plane parameters.

3. The machine of claim 1, wherein the controller, to determine the plane offset information, is configured to:

determine respective differences between corresponding plane parameters of the one or more reference target plane parameters and the one or more reference track plane parameters.

4. The machine of claim 1, wherein the controller, to modify the one or more dynamic track plane parameters, is configured to:

apply a low-pass filter, of the one or more filters, that corresponds to a dynamic track plane parameter, of the one or more dynamic track plane parameters, to the dynamic track plane parameter.

5. The machine of claim 4, the low-pass filter is associated with one or more filter coefficients, wherein the controller, to apply the low-pass filter to the dynamic track plane parameter, is configured to:

determine, based on at least one of a configuration setting of the machine or sensor information associated with the machine, the one or more filter coefficients; and apply the low-pass filter to the dynamic track plane parameter using the one or more filter coefficients.

6. The machine of claim 1, wherein the controller, to determine the dynamic target plane, is configured to:

determine, based on a modified plane orientation parameter, of the modified one or more dynamic track plane parameters, and a corresponding portion of the plane offset information, a plane orientation parameter; and determine, based on the plane orientation parameter, the dynamic target plane.

7. The machine of claim 1, wherein the controller, to determine the dynamic target plane, is configured to:

determine, based on a modified plane elevation parameter, of the modified one or more dynamic track plane parameters, and a corresponding portion of the plane offset information, an offset-adjusted plane elevation parameter;

determine, based on the offset-adjusted plane elevation parameter and a plane elevation parameter, of the one or more reference target plane parameters, a plane origin point elevation parameter; and determine, based on the plane origin point elevation parameter, the dynamic target plane.

8. The machine of claim 1, wherein the controller, to determine the dynamic target plane, is configured to:

determine, based on the modified one or more dynamic track plane parameters, a plane origin point elevation parameter;

determine, based on sensor information, at least one plane origin point lateral parameter; and determine, based on the plane origin point elevation parameter and the at least one plane origin point lateral parameter, the dynamic target plane.

9. The machine of claim 1, wherein the controller, to determine the dynamic target plane, is configured to:

determine, based on a modified plane elevation parameter, of the modified one or more dynamic track plane parameters, a plane origin point of the dynamic target plane;

determine, based on at least one modified plane orientation parameter, of the modified one or more dynamic track plane parameters, an orientation of the dynamic target plane; and determine, based on the plane origin point of the dynamic target plane and the orientation of the dynamic target plane, the dynamic target plane.

10. The machine of claim 1, wherein the controller, to control the implement, is configured to:

determine, based on the dynamic target plane, a target position of the implement; and adjust the implement to achieve the target position.

11. A controller of a machine, comprising:

one or more memories; and one or more processors, coupled to the one or more memories, configured to:

determine one or more reference target plane parameters associated with a reference target plane for an implement of the machine for when the machine performs an operation;

determine, based on the one or more reference target plane parameters and one or more reference track plane parameters associated with a reference track plane of the machine, plane offset information;

determine, when the machine performs the operation, one or more dynamic track plane parameters associated with a dynamic track plane of the machine;

modify, using one or more filters, the one or more dynamic track plane parameters;

determine, based on the modified one or more dynamic track plane parameters and the plane offset information, a dynamic target plane for the implement; and control the implement based on the dynamic target plane.

12. The controller of claim 11, wherein the plane offset information indicates respective differences between corresponding plane parameters of the one or more reference target plane parameters and the one or more reference track plane parameters.

13. The controller of claim 11, wherein the one or more processors, to modify the one or more dynamic track plane parameters, are configured to:

apply a filter, of the one or more filters, that corresponds to a dynamic track plane parameter, of the one or more dynamic track plane parameters, to the dynamic track plane parameter.

14. The controller of claim 11, wherein the one or more processors, to determine the dynamic target plane, are configured to:

determine, based on a modified plane orientation parameter, of the modified one or more dynamic track plane parameters, and a corresponding portion of the plane offset information, a plane orientation parameter; and determine, based on the plane orientation parameter, the dynamic target plane.

15. The controller of claim 11, wherein the one or more processors, to determine the dynamic target plane, are configured to:

determine, based on a modified plane elevation parameter, of the modified one or more dynamic track plane parameters, and a corresponding portion of the plane offset information, an offset-adjusted plane elevation parameter;

determine, based on the offset-adjusted plane elevation parameter and a plane elevation parameter, of the one or more reference target plane parameters, a plane origin point elevation parameter; and determine, based on the plane origin point elevation parameter, the dynamic target plane.

16. The controller of claim 11, wherein the one or more processors, to determine the dynamic target plane, are configured to:

determine, based on the modified one or more dynamic track plane parameters, a plane origin point elevation parameter;

determine, based on sensor information, at least one plane origin point lateral parameter; and determine, based on the plane origin point elevation parameter and the at least one plane origin point lateral parameter, the dynamic target plane.

17. The controller of claim 11, wherein the one or more processors, to determine the dynamic target plane, are configured to:

determine, based on a modified plane elevation parameter, of the modified one or more dynamic track plane parameters, a plane origin point of the dynamic target plane;

determine, based on at least one modified plane orientation parameter, of the modified one or more dynamic track plane parameters, an orientation of the dynamic target plane; and determine, based on the plane origin point of the dynamic target plane and the orientation of the dynamic target plane, the dynamic target plane.

18. A method, comprising:

determining, by a controller of a machine, plane offset information associated with a reference target plane for an implement of the machine and a reference track plane of the machine;

determining, by the controller, one or more dynamic track plane parameters associated with a dynamic track plane of the machine;

modifying, by the controller, using one or more filters, the one or more dynamic track plane parameters; and determining, by the controller, based on the modified one or more dynamic track plane parameters and the plane offset information, a dynamic target plane for the implement.

19. The method of claim 18, wherein determining the dynamic target plane comprises:

determining, based on a modified plane orientation parameter, of the modified one or more dynamic track plane parameters, and a corresponding portion of the plane offset information, a plane orientation parameter; and determining, based on the plane orientation parameter, the dynamic target plane.

20. The method of claim 18, wherein determining the dynamic target plane comprises:

determining, based on a modified plane elevation parameter, of the modified one or more dynamic track plane parameters, and a corresponding portion of the plane offset information, an offset-adjusted plane elevation parameter;

determining, based on the offset-adjusted plane elevation parameter, a plane origin point elevation parameter; and determining, based on the plane origin point elevation parameter, the dynamic target plane.

* * * * *